US011651733B1

(12) United States Patent
Sun

(10) Patent No.: US 11,651,733 B1
(45) Date of Patent: May 16, 2023

(54) PIXEL CIRCUIT, DISPLAY DEVICE AND DRIVING METHOD THEREOF

(71) Applicant: TianYi Microelectronics (Beijing) Co., Ltd., Beijing (CN)

(72) Inventor: Lina Sun, Beijing (CN)

(73) Assignee: TIANYI MICROELECTRONICS (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/978,956

(22) Filed: Nov. 1, 2022

(30) Foreign Application Priority Data

Apr. 29, 2022 (CN) ..... 202210493944.1

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01); *G09G 2300/0852* (2013.01); *G09G 2310/08* (2013.01); *G09G 2320/0223* (2013.01); *G09G 2320/0233* (2013.01)

(58) Field of Classification Search
CPC ..... G09G 3/3233; G09G 3/3258; G09G 2300/0819; G09G 2300/0852; G09G 2310/08; G09G 2320/0223; G09G 2320/0233; G09G 3/3225; G09G 2300/088; G09G 2310/0243; G09G 2320/0257; G09G 2320/0276; G09G 2320/066
See application file for complete search history.

(56) References Cited

U.S. PATENT DOCUMENTS

2017/0132975 A1* 5/2017 Park ..... G09G 3/3266

FOREIGN PATENT DOCUMENTS

| | | | |
|---|---|---|---|
| CN | 102593151 | A | 7/2012 |
| CN | 103050080 | A | 4/2013 |
| CN | 103076680 | A | 5/2013 |
| CN | 103093720 | A | 5/2013 |
| CN | 103886828 | A | 6/2014 |
| CN | 104680978 | A | 6/2015 |
| CN | 104809989 | A | 7/2015 |
| CN | 108206008 | A | 6/2018 |
| CN | 113870775 | A | 12/2021 |

* cited by examiner

*Primary Examiner* — Stacy Khoo
(74) *Attorney, Agent, or Firm* — Treasure IP Group, LLC

(57) ABSTRACT

A pixel circuit, a display device and a driving method thereof are provided. The pixel circuit includes: a light emitting diode; a first transistor for controlling an operation of writing a data voltage; a second transistor for controlling a light emitting time of the light emitting diode; a third transistor for controlling a driving transistor initializing; a fourth transistor for resetting a voltage of an anode of the light emitting diode; a first capacitor and a second capacitor connected between the data voltage and a stable signal storing a threshold voltage of the driving transistor and an attenuated data voltage; the driving transistor for driving the light emitting diode. The pixel circuit solves problem of non-uniform brightness caused by discrete threshold voltage of the driving transistor and voltage drop of power voltage, enlarges range of gamma voltage, avoids coupling effect brought by second capacitor, and is favorable for circuit layout.

8 Claims, 4 Drawing Sheets

PIXEL CIRCUIT, DISPLAY DEVICE AND DRIVING METHOD THEREOF

CROSS-REFERENCE TO RELATED APPLICATION

This application claims priority to the Chinese Patent Application No. 202210493944.1, filed on Apr. 29, 2022, entitled "pixel circuit, display device and driving method thereof", and published as CN114882838A on Aug. 9, 2022, which is incorporated herein by reference in its entirety in this disclosure.

BACKGROUND OF THE DISCLOSURE

Field of Technology

The present disclosure relates to a field of display technologies, and in particular, to a pixel circuit, a display device and a driving method thereof.

Description of the Related Art

An Organic Light Emitting Diode (OLED) is widely used in a field of display devices because of its characteristics of self-luminescence, wide viewing angle display, fast response, and being capable of being manufactured on a flexible substrate.

In a current display panel, since threshold voltages of driving transistors in different pixel circuits are different, and/or drift happens with time in the threshold voltages of the driving transistors in the pixel circuits, currents of light emitting diodes in the pixel circuits are different, and the display panel has poor uniformity of display brightness and poor image quality.

Therefore, an improved pixel circuit is needed to solve the above technical problems.

SUMMARY OF THE INVENTION

In view of the above problems, an objective of the present disclosure is to provide a pixel circuit, a display device and a driving method thereof, so as to solve the problem of non-uniform brightness caused by the dispersion of threshold voltages of driving transistors and the power voltage drop, and facilitate the design of a circuit layout.

According to an aspect of the present disclosure, there is provided a pixel circuit, comprising: a light emitting diode; a first transistor for controlling an operation of writing data voltage when the first transistor is in "on state", wherein on and off states of the first transistor are controlled by a scan signal; a second transistor for controlling a light emitting time of the light emitting diode, wherein on and off states of the second transistor are controlled by a dimming control signal; a third transistor for controlling initialization of a driving transistor when the third transistor is in on state, wherein on and off states of the third transistor are controlled by an initialization control signal; a fourth transistor for resetting a voltage of an anode of the light emitting diode periodically, wherein on and off states of the fourth transistor are controlled by a discharge control signal; a first capacitor for storing a threshold voltage of the driving transistor in an initialization stage; a second capacitor connected in series with the first capacitor between the data voltage and a stable signal, wherein the first capacitor and the second capacitor are used for dividing the data voltage in a writing stage, so that the first capacitor is configured to store an attenuated data voltage; and the driving transistor provides a driving current or a driving voltage to the anode of the light emitting diode based on a power voltage, the threshold voltage, and the attenuated data voltage in a light emitting stage.

Optionally, a gate of the first transistor is connected with a scanning line to receive the scan signal, and a first terminal of the first transistor is connected with a data line to receive the data voltage; a gate of the second transistor receives the dimming control signal, and a first terminal of the second transistor is connected with a power line to receive the power voltage; a gate of the driving transistor is connected with a second terminal of the first transistor, a first terminal of the driving transistor is connected with a second terminal of the second transistor, and a second terminal of the driving transistor is connected with the anode of the light emitting diode; a gate of the third transistor receives the initialization control signal, a first terminal of the third transistor receives an initialization voltage, and a second terminal of the third transistor is connected with the gate of the driving transistor; a gate of the fourth transistor receives the discharge control signal, a first terminal of the fourth transistor is connected with a discharge voltage, and a second terminal of the fourth transistor is connected with the second terminal of the driving transistor; the first capacitor is connected between the gate of the driving transistor and the first terminal of the driving transistor; the second capacitor is connected between the first terminal of the driving transistor and the stable signal; and a cathode of the light emitting diode receives a common voltage.

Optionally, the stable signal is any one selected from the power voltage, the initialization voltage, the discharge voltage, the dimming control signal, the initialization control signal, and the discharge control signal.

Optionally, the initialization voltage is a constant voltage having a voltage value smaller than a difference between the power voltage and an absolute value of the threshold voltage of the driving transistor, and the initialization control signal is a scan signal for controlling a previous row of pixel circuits.

Optionally, the discharge voltage is a constant voltage, and a difference between a voltage value of the constant voltage and a voltage value of the cathode of the light emitting diode is smaller than an on-voltage of the light emitting diode.

Optionally, the first capacitor and the second capacitor are selected from one or more of a metal-insulator-metal (MIM) capacitor, a metal-oxide-semiconductor (MOS) capacitor, and a metal-oxide-metal (MOM) capacitor, wherein the first capacitor and the second capacitor are stacked capacitors.

According to a second aspect of the present disclosure, there is provided a display device comprising a plurality of pixel circuits according to any pixel circuit disclosed in the present disclosure, and the plurality of pixel circuits are arranged in an array.

Optionally, the plurality of pixel circuits form a pixel array, first terminals of the first transistors in the pixel circuits in a same column in the pixel array share one data line, and gates of the first transistors in the pixel circuits in a same row in the pixel array share one scanning line; gates of the second transistors in the pixel circuits in a same row in the pixel array share one dimming control signal, and first terminals of the second transistors in the pixel circuits in a same row in the pixel array share one power voltage, or first terminals of the second transistors in the pixel circuits in the pixel array share one power voltage; gates of the third transistors in the pixel circuits in a same row in the pixel array share one initialization control signal, and first terminals of the third transistors in the pixel circuits in a same row in the pixel array share one initialization voltage, or first terminals of the third transistors in the pixel circuits in the pixel array share one initialization voltage; gates of the fourth transistors in the pixel circuits in a same row in the pixel array share one discharge control signal, and first terminals of the fourth transistors in the pixel circuits in a same row in the pixel array share one discharge voltage, or first terminals of the fourth transistors in the pixel circuits in the pixel array share one discharge voltage.

According to a third aspect of the present disclosure, there is provided a driving method of a pixel circuit, comprising: storing a threshold voltage of a driving transistor by using a first capacitor in an initialization stage; dividing a data voltage by using the first capacitor and the second capacitor connected in series between the data voltage and a stable signal, so as to store an attenuated data voltage by use of the first capacitor in a writing stage; and providing a driving current or a driving voltage to an anode of the light emitting diode based on a power voltage, the threshold voltage, and the attenuated data voltage in a light emitting stage by using a driving transistor in a light emitting stage, wherein the second capacitor is electrically isolated from the light emitting diode in the writing stage.

Optionally, in the initialization stage and/or the writing stage, a voltage of the anode of the light emitting diode is reset; in the initialization stage, the driving transistor is disconnected from the power voltage, and the threshold voltage of the driving transistor is obtained through an electric leakage of the driving transistor; and a light emitting time of the light emitting diode is controlled by controlling an on-time of the second transistor and/or an off-time of the fourth transistor to adjust brightness of the light emitting diode.

According to the pixel circuit provided by embodiments of the present disclosure, the first capacitor is used for storing the threshold voltage of the driving transistor in the initialization stage, so that display non-uniformity caused by voltage drop on a power line and display non-uniformity caused by different threshold voltages of the driving transistors can be compensated, the first capacitor and the second capacitor are used for dividing the data voltage in the writing stage, a range of gamma voltage can be expanded, and negative effects of transistor leakage on brightness and contrast can be reduced; the second capacitor is electrically isolated from the light emitting diode in the writing stage, so that current cannot flow into the light emitting diode, the light emitting diode is prevented from being influenced, and the light emitting diode cannot be negatively influenced due to coupling effect in the light emitting stage; in addition, the second capacitor is directly connected with any form of the stable signal shared by other components, so that the components are not too dense, and layout design is facilitated.

Further, the pixel circuit includes the first transistor, the second transistor, the third transistor, the fourth transistor, the first capacitor, the second capacitor, the light emitting diode and the driving transistor, the circuit has high integration, and the pixel circuit is suitable for high pixels per inch (ppi) silicon-based micro OLED/LED display.

Further, the voltage of the anode of the light emitting diode can be periodically reset by controlling the fourth transistor through the discharge control signal, so that dynamic contrast can be increased, and phenomenon that charges on the anode cannot be discharged quickly to cause smear when pixel light emitting state is changed from a bright state to a dark state is prevented. Meanwhile, a service life of the light emitting diode can be prolonged by periodically resetting the voltage of the anode of the light emitting diode, and the phenomenon of image sticking is reduced.

BRIEF DESCRIPTION OF THE DRAWINGS

Through the following description of the embodiments of the present disclosure with reference to the accompanying drawings, the above and other objectives, features, and advantages of the present disclosure will be more apparent, in the accompanying drawings.

DETAILED DESCRIPTION OF THE DISCLOSURE

Figure 1:
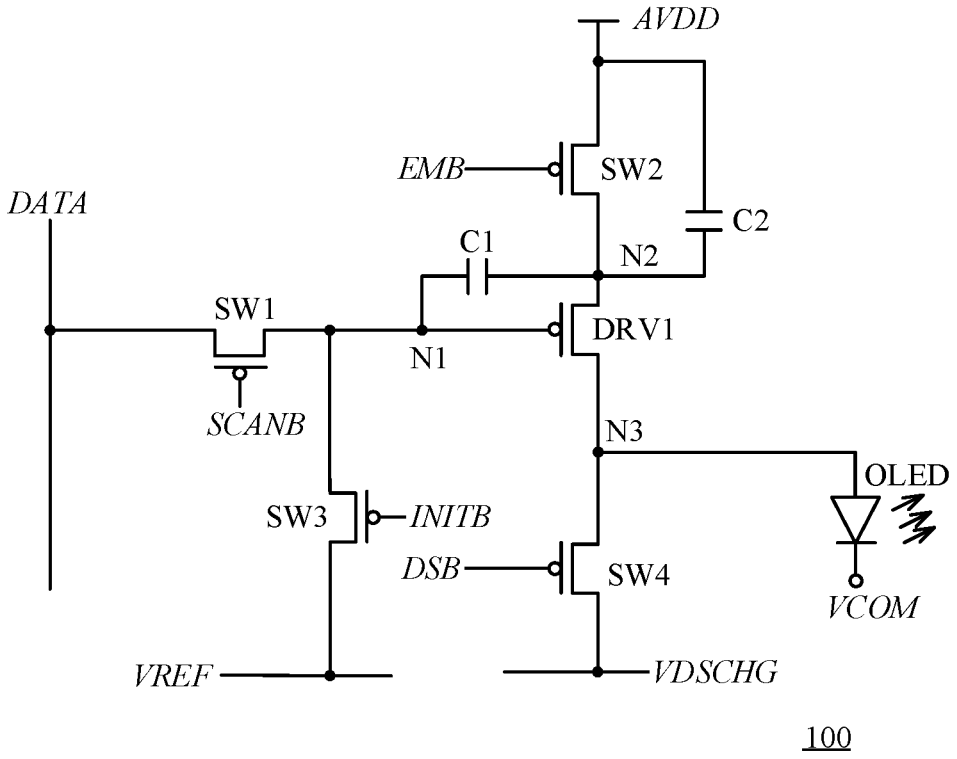
FIG. 1 shows a schematic structural diagram of a pixel circuit according to an embodiment of the present disclosure.

The disclosure will be described in more details below with reference to the accompanying drawings. Similar elements are denoted by similar reference numerals throughout the various Figures. For purposes of clarity, the various features in the drawings are not drawn to scale. Moreover, certain well-known elements may not be shown in the Figures.

In the following descriptions, numerous specific details of the disclosure, such as structures, materials, dimensions, processing techniques and techniques of the devices are described in order to provide a more thorough understanding of the disclosure. However, as will be understood by those skilled in the art, the present disclosure may be achieved without these specific details.

It should be understood that, in the embodiments of the present disclosure, A and B are connected/coupled, which means that A and B may be connected in series or in parallel, or A is connected to B through other devices, and the embodiments of the present disclosure do not limit this.

A display panel of an OLED (Organic Light Emitting Diode) display panel includes a plurality of pixel circuits, and a common pixel circuit of the OLED display panel includes a light emitting diode (OLED), a driving transistor, a first transistor, and a first capacitor. A gate of the first transistor is connected with a scanning line and receives scan signals, a first terminal of the first transistor is connected with a data line and receives data voltage, and a second terminal of the first transistor is connected with a gate of the driving transistor. A first terminal of the driving transistor is connected with a power line and receives power voltage, and a second terminal of the driving transistor is connected with an anode of the light emitting diode. A cathode of the light emitting diode is connected with a common voltage line and receives a common voltage. One end of the first capacitor is connected with the second terminal of the first transistor, and the other end of the first capacitor is connected with the second terminal of the driving transistor. The light emitting diode OLED/LED is driven to operate in a writing stage and a light emitting stage. In the writing stage, the first transistor is in on state, and the data voltage is written into the light emitting diode and stored in the first storage capacitor. In the light emitting stage, the first transistor is in off state, the driving transistor is in on state, and the light emitting diode is controlled to emit light, so that image display is realized.

However, difference in the threshold voltages of the driving transistors between different pixel circuits in the OLED display panel or drift of the threshold voltage of the driving transistor in the pixel circuit with time may cause difference in currents of the light emitting diodes (OLED) of the pixel circuits, which may further cause the OLED display panel to have poor uniformity of display brightness and poor image quality.

At present, for the pixel circuit includes thin film transistors, an improvement scheme aiming at non-uniformity of the threshold voltage of the thin film transistor, the drift of the threshold voltage of the thin film transistor and the non-uniformity of the electrical performance of the light emitting diode OLED/LED is provided, and a control transistor for reading the threshold voltage and correspondingly compensating is additionally arranged in the pixel circuit, so that the display effect is improved. However, mobility of a single crystal silicon CMOS (Complementary Metal Oxide Semiconductor) transistor is high, and the current of the light emitting diode required by each pixel in the silicon-based micro-OLED display panel is very small, and the improvement scheme provided by the prior art may cause gate voltage range of the driving transistor to be very narrow, and further cause the gamma voltage to have insufficient precision, resulting in poor image quality.

Therefore, inventor of the present disclosure designs a pixel circuit, a display panel, and a driving method thereof to solve the above-mentioned technical problems.

The pixel circuit provided by the present disclosure includes switch transistors and a driving transistor which are transistors, wherein the transistors are monocrystalline silicon CMOS transistors, and the pixel circuit is a pixel circuit in a silicon-based micro OLED/LED display panel. A display area of the silicon-based micro OLED/LED display panel includes a plurality of pixel circuits arranged in an array, for example.

Embodiments of a pixel circuit, a display device, and a driving method thereof provided by the present disclosure will be described below with reference to drawings.

Figure 2:
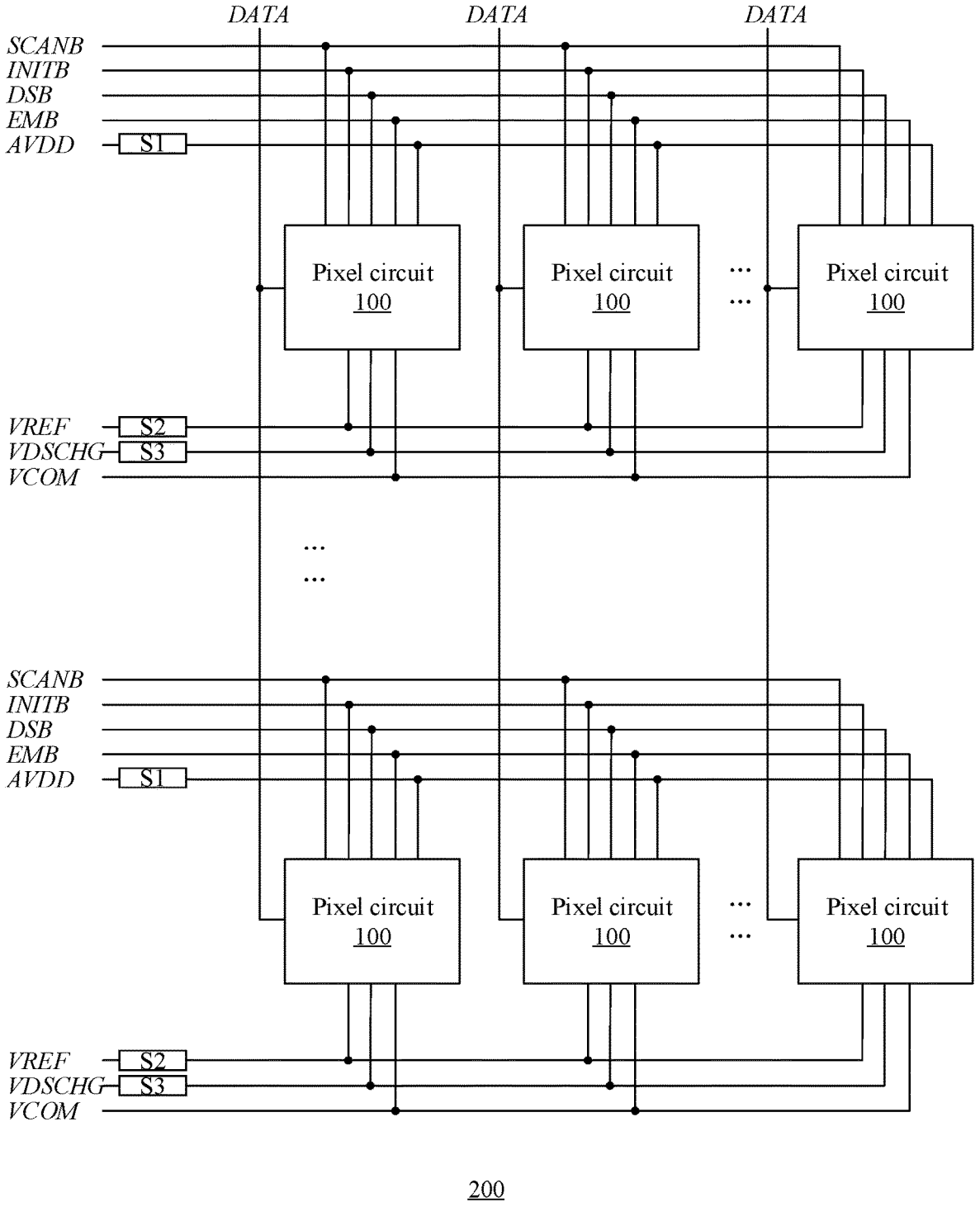
FIG. 2 shows a block diagram of a display device according to an embodiment of the present disclosure.
Figure 3:
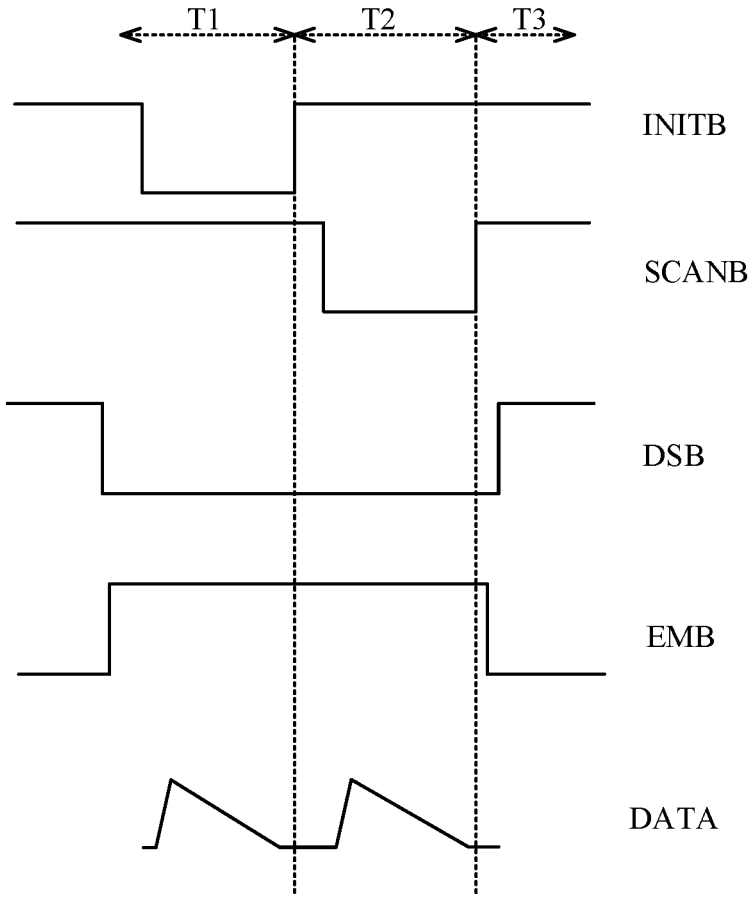
FIG. 3 shows a timing diagram of the pixel circuit according to an embodiment of the present disclosure.

FIG. 1 shows a schematic structural diagram of a pixel circuit according to an embodiment of the present disclosure. FIG. 2 shows a block diagram of a display device according to an embodiment of the present disclosure. Based on an exemplary configuration, FIG. 3 shows a timing diagram of the pixel circuit according to an embodiment of the present disclosure.

As shown in FIG. 1, a pixel circuit 100 in an OLED/LED display panel includes a first transistor SW1, a driving transistor DRV1, a light emitting diode OLED/LED, a first capacitor C1, a second capacitor C2, a second transistor SW2, a third transistor SW3, and a fourth transistor SW 4. The first transistor SW1 is configured to control an operation of writing a data voltage DATA when the first transistor SW1 is in on state, and on and off states of the first transistor SW1 are controlled by a scan signal SCANB. The second transistor is configured to control a light emitting time of the light emitting diode OLED/LED/LED, and on and off states of the second transistor are controlled by a dimming control signal EMB. The driving transistor DRV1 provides a driving current or a driving voltage to an anode of the light emitting diode OLED/LED based on the data voltage DATA and a power voltage AVDD which is received through the second transistor SW2 to make the emitting happen, so that the pixel circuit 100 is configured to support both an analog gamma curve and PWM method to adjust the brightness. The third transistor SW3 is configured to control the initialization of the driving transistor DRV1 when the third transistor SW3 is in on state, and on and off states of the third transistor SW3 are controlled by an initialization control signal INITB. The fourth transistor SW4 is configured to reset a voltage of the anode of the light emitting diode OLED/LED periodically, and on and off states of the fourth transistor SW4 are controlled by a discharge control signal DSB. The first capacitor C1 is configured to store a threshold voltage VTH1 of the driving transistor DRV1, which is an actual threshold voltage of the driving transistor DRV1, in an initialization stage, and store an attenuated value of the data voltage DATA through the first capacitor C1 and the second capacitor C2 in the writing stage of the pixel circuit. The second capacitor C2 performs attenuation on the data voltage DATA by a scaling factor between the second capacitor C2 and the first capacitor C1. In a light emitting stage of the light emitting diode, the driving transistor DRV1 makes the light emitting diode OLED/LED emit light based on an attenuated data voltage stored by the first capacitor C1 in the writing stage and the power voltage AVDD received through the second transistor SW2.

Specifically, a gate of the first transistor SW1 is connected with a scan line and receives the scan signal SCANB, a first terminal of the first transistor SW1 is connected with a data line and receives the data voltage DATA, and a second terminal of the first transistor SW1 is connected with a gate of the driving transistor DRV1, wherein a connection node between the second terminal of the first transistor SW1 and the gate of the driving transistor DRV1 serves as a first node N1.

A gate of the second transistor SW2 receives the dimming control signal EMB, a first terminal of the second transistor SW2 is connected with a power line and receives the power voltage AVDD, and a second terminal of the second transistor SW2 serves as a second node N2.

A first terminal of the driving transistor DRV1 is connected with the second node N2, is connected with the power line through the second transistor SW2, and receives the power voltage AVDD, and a second terminal of the driving transistor DRV1 is connected with the anode of the light emitting diode OLED/LED and serves as a third node N3. A cathode of the light emitting diode OLED/LED is connected with a common voltage line and receives a common voltage VCOM.

The first capacitor C1 is connected between the first node N1 and the second node N2, that is, the first capacitor C1 is connected between the gate and the first terminal of the driving transistor DRV1.

One terminal of the second capacitor C2 is connected with the first terminal of the driving transistor DRV1, and the other terminal of the second capacitor C2 is connected with a stable signal. In this embodiment, a specific connection embodiment of the second capacitor C2 will be described by taking the stable signal as the power voltage AVDD as an example. It should be understood that the stable signal may be any one selected from the power voltage AVDD, an initialization voltage VREF, a discharge voltage VDSCHG, the dimming control signal EMB, the initialization control signal INITB, the discharge control signal DSB, and the like, and the present disclosure does not limit a specific form of the stable signal, and may be a voltage source, a signal source, and even a connection node having a stable voltage in a circuit, as long as it can provide a stable voltage in a writing stage. The second capacitor C2 is directly connected with any form of the stable signal shared by other components, so that the components are not too dense, and layout design is facilitated.

A gate of the third transistor SW3 receives the initialization control signal INITB, a first terminal of the third transistor SW3 receives the initialization voltage VREF, and a second terminal of the third transistor SW3 is connected with the first node N1.

A gate of the fourth transistor SW4 is connected with the switching control signal DSB, a first terminal of the fourth transistor SW4 is connected with the switching voltage VDSCHG, and a second terminal of the fourth transistor SW4 is connected with the anode of the light emitting diode OLED/LED.

It should be noted that a voltage difference between the discharge voltage VDSCHG and the common voltage VCOM is smaller than a turn-on voltage of the light emitting diode OLED/LED. The initialization voltage VREF is less than a difference between the power voltage AVDD and an absolute value of a target threshold voltage VTHP of the driving transistor DRV1. In the present embodiment, the initialization voltage VREF is, for example, 3V. The scan signal SCANB is shared by the pixel circuits in the same row, the discharge control signal DSB is shared by the pixel circuits in the same row, the initialization control signal INITB is shared by the pixel circuits in the same row, and the dimming control signal EMB is shared by the pixel circuits in the same row. One data voltage DATA is shared by the pixel circuits located in the same column. In some alternative embodiments, the initialization voltage VREF, the discharge voltage VDSCHG, the power voltage AVDD, and the common voltage VCOM are commonly shared by all pixel circuits of display region in the entire display panel. In other alternative embodiments, the initialization voltage VREF, the discharge voltage VDSCHG, the power voltage AVDD, and the common voltage VCOM are respectively shared by the pixel circuits in the same row. The first capacitor C1 and the second capacitor C2 are storage capacitors, and may be metal-oxide-semiconductor (MOS) capacitors, metal-insulator-metal (MIM) capacitors, or metal-oxide-metal (MOM) capacitors. In a preferred embodiment, the first capacitor C1 and the second capacitor C2 are metal-insulator-metal capacitors, which may be stacked capacitors integrated on metal-oxide-semiconductor transistors, and do not occupy area of a pixel circuit, thereby reducing overall area of a display panel, better realizing miniaturization of a display device, and making capacitance ratio more consistent.

It should be noted that source terminals and drain terminals of the driving transistor DRV1, the first transistor SW1, the second transistor SW2, the third transistor SW3 and the fourth transistor SW4 are symmetrical, so the source terminal and the drain terminal of each transistor can be interchanged. Further, the gates of the above transistors are gate terminals, and the first terminals and the second terminals thereof are source terminals and drain terminals, respectively, or drain terminals and source terminals, respectively. In the present embodiment, the driving transistor DRV1, the first switch transistor SW1, the second switch transistor SW2, the third switch transistor SW3 and the fourth switch transistor SW4 are all positive-channel metal oxide semiconductor (PMOS) transistors. However, under the condition of process support, the transistors may be replaced by negative-channel metal oxide semiconductor (NMOS) transistors, or a combination of PMOS transistors and NMOS transistors, and polarities of the control signals need to be changed correspondingly, as long as the PMOS transistors and the NMOS transistors can be turned on and off at different stages.

Next, wiring arrangement of a display device 200 according to an embodiment of the present disclosure is exemplarily described with reference to FIG. 2. As shown in FIG. 2, the display device 200 of this embodiment includes a plurality of data lines DATA, a plurality of scan lines SCANB, a plurality of initialization control signal lines INITB, a plurality of discharge control signal lines DSB, a plurality of dimming control signal lines EMB, a plurality of power lines AVDD, a plurality of initialization voltage lines VREF, a plurality of discharge voltage lines VDSCHG, a plurality of common voltage lines VCOM, and a plurality of pixel circuits 100. The plurality of pixel circuits 210 are arranged in an array, that is, a pixel array is formed by the plurality of pixel circuits 210.

In this embodiment, for each row of the pixel circuits 100, a switch S1 is connected with a front end of the power line AVDD shared by the pixel circuits 100 in that row, a switch S2 is connected with a front end of the initialization voltage line VREF shared by the pixel circuits 100 in that row, and a switch S3 is connected with a front end of the discharging voltage line VDSCHG shared by the pixel circuits 100 in that row. Switches with same reference numerals are controlled by synchronized switching signals respectively.

Specifically, in each row of pixel circuits 100, the gates of the first transistor SW1 of each pixel circuit 100 share one scan line SCANB; the gates of the second transistors SW2 in each pixel circuit 100 share one dimming control signal line EMB; the first terminal of the second transistor SW2 in each pixel circuit 100 shares one power line AVDD; the gates of the third transistors SW3 in the respective pixel circuits 100 share one initialization voltage line VREF; the first terminals of the third transistors SW3 in the respective pixel circuits 100 share one initialization voltage line VREF; the gates of the fourth transistors SW4 in the respective pixel circuits 100 share one discharging voltage line VDSCHG; the first terminals of the fourth transistors SW4 in the respective pixel circuits 100 shares a discharging voltage line VDSCHG; the cathodes of the light emitting diodes OLED in the respective pixel circuits 100 share one common voltage line VCOM.

In each column of pixel circuits 100, the pixel driving circuits 210 are commonly connected with the data line DATA to receive a corresponding data voltage.

It should be understood that in some other embodiments, the initialization voltage VREF, the discharge voltage VDSCHG, the power voltage AVDD, and the common voltage VCOM are commonly shared by all pixel circuits of the display region in the entire display device. Specifically, the first terminals of the second transistors SW2 in the pixel circuits 100 in the entire pixel array share one power line AVDD; the first terminals of the third transistors SW3 in the pixel circuits 100 in the entire pixel array share one initialization voltage line VREF; the first terminals of the fourth transistors SW4 in the pixel circuits 100 in the entire pixel array share one discharging voltage line VDSCHG. The present disclosure does not limit the specific connection relationship between these signal lines, voltage lines, and the respective pixel circuits 100.

Next, with reference to FIG. 3, an operation principle of the pixel circuit 100 will be described with reference to a timing diagram of the pixel circuit 100. During one operation period, the pixel circuit 100 is mainly operated in an initialization stage, a writing stage, and a light emitting stage.

In the initialization stage T1, the initialization control signal INITB is at an active level, the discharge control signal DSB is at an active level, the dimming control signal EMB is at an inactive level, and the scan signal SCANB is at an inactive level. So that the first transistor SW1 is controlled to be in off state, the second transistor SW2 is controlled to be in off state, the third transistor SW3 is controlled to be in on state, and the fourth transistor SW4 is controlled to be in on state. Further, the initialization voltage VREF is applied (written) to the first node N1, the second node N2 is disconnected from the power voltage AVDD due to a disconnection of the second transistor SW2, the voltage value at the second node N2 is decreased by a leakage of the driving transistor DRV1, and approaches a sum of the initialization voltage VREF and the threshold voltage VTH1 of the driving transistor DRV1, and the discharge voltage VDSCHG is applied (written) in the third node N3. The threshold voltage VTH1 of the driving transistor DRV1 is further stored in the first capacitor C1, which is completed before the data writing stage because a voltage at the second node N2 needs a long time to drop. The threshold voltage VTH1=(1+m)×VTHP, wherein m=lamda (AVDD−VN2), and m is an influence coefficient of a substrate bias effect, and VN2 is a voltage value at the second node N2.

In the writing stage T2, the initialization control signal INITB is at an inactive level, the discharge control signal DSB is at an active level, the dimming control signal EMB is at an inactive level, and the scan signal SCANB is at an active level. So that the first transistor SW1 is controlled to be in on state, the second transistor SW2 is controlled to be in off state, the third transistor SW3 is controlled to be in off state, and the fourth transistor SW4 is controlled to be in on state. Further, a voltage value VN1 at the first node N1 is the same as the data voltage DATA, and data writing operation is completed. A voltage at the second node N2 is a voltage obtained by dividing the data voltage DATA across the first capacitor C1 and the second capacitor C2, and the voltage value VN2=VN1+VTH1+α(DATA−VREF), wherein α=C1/(C1+C2). At an end of the writing stage, an attenuated data voltage which is obtained by performing attenuation on the data voltage DATA is stored in the first capacitor C1.

In the light emitting period T3, the initialization control signal INITB is at an inactive level, the discharge control signal DSB is at an inactive level, the dimming control signal EMB is at an active level, and the scan signal SCANB is at an inactive level. So that the first transistor SW1 is controlled to be in off state, the second transistor SW2 is controlled to be in on state, the third transistor SW3 is controlled to be in off state, the fourth transistor SW4 is controlled to be in off state, and the driving transistor DRV1 is configured to provide a driving current or a driving voltage based on the attenuated data voltage stored in the first capacitor C1 and the power voltage AVDD to make the light emitting diode OLED/LED emit light. Further, the voltage value VN2 at the second node N2 is the same as the power voltage AVDD, and the voltage value VN1 at the first node N1 is VN1=DATA+β(AVDD−(VREF+VTH1+α(DATA−VREF)))=(1−αβ)DATA+βAVDD−βVTH1−βVREF+αβVREF, wherein β=C1/(C1+Cpn1), Cpn1 is a parasitic capacitance of the first node N1. C1>>Cpn1, β≈1, then VN1=(1−α)DATA+AVDD−VTH1−(1−α)VREF. When the load is large current and works in a saturation region, Ioled=K(Vgs−VTHP)^2=K(AVDD−VN1−VTHP)^2=K((1−α)VREF−(1−α)DATA+m*VTHP)^2, the load current Ioled is irrelevant to the power voltage AVDD, a relevance between the load current Ioled and the target threshold value VTHP of the driving transistor DRV1 is greatly reduced, and the range of gamma voltage is expanded. Wherein, C1/C2 can be 1:1, or 1:2, or 2:1 or other ratio. When the same load current Ioled is provided, the range of the data voltage DATA of the pixel circuit 100 provided in the present disclosure is wider, and thus the range of the gamma voltage can be extended. According to a formula α=C1/(C1+C2), where the larger a is, the less the load current Ioled is affected by the data voltage DATA, and thus the expansion range of the gamma voltage is larger. And then can obtain better dimming effect, promoted quality of image display. Where K is a factor related to a size of the driving transistor DRV1 and semiconductor process.

In an alternative embodiment, the initialization control signal INITB is the scan signal SCANB outputted from the previous scan line, which reduces a design complexity of a line scan controller in the display device.

It should be noted that the discharge control signal DSB can periodically reset the anode voltage of the light emitting diode OLED/LED, so as to increase the dynamic contrast and prevent the charge on the anode from being discharged quickly to cause a smear when the pixel emits light from a bright state to a dark state. Meanwhile, the service life of the OLED device can be prolonged by periodically resetting the anode voltage of the light emitting diode OLED/LED, and the phenomenon of image sticking is reduced. And by controlling the on-time of the second transistor SW2 and/or the off-time of the fourth transistor SW4, the light emitting time of the light emitting diode OLED/LED can be controlled, so as to adjust the brightness of the display device without changing the gamma curve.

Figure 4:
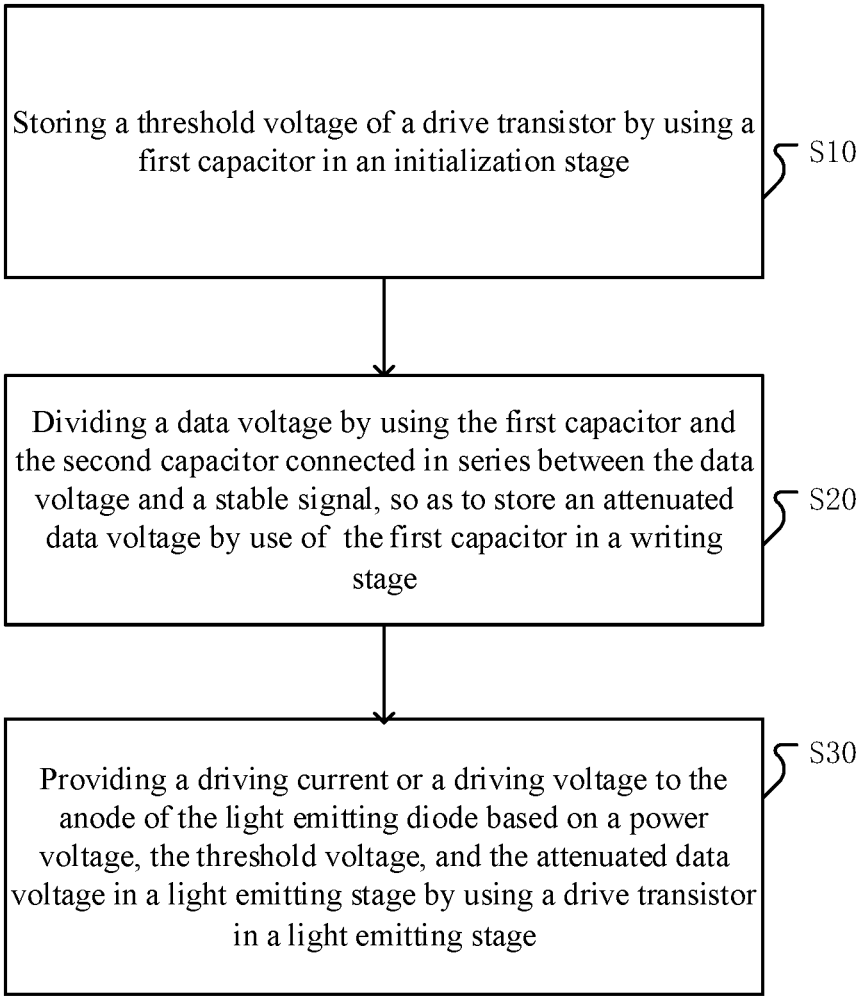
FIG. 4 shows a flow chart of a driving method of the pixel circuit according to an embodiment of the present disclosure.

FIG. 4 shows a schematic flowchart of a pixel circuit driving method provided in an embodiment of the present disclosure.

As shown in FIG. 4, the driving method of the pixel circuit includes following steps:

Step S10: storing a threshold voltage of a driving transistor by using a first capacitor in an initialization stage. In this step, the initialization control signal INITB is at an active level, the discharge control signal DSB is at an active level, the dimming control signal EMB is at an inactive level, and the scan signal SCANB is at an inactive level. So that the first transistor SW1 is controlled to be in off state, the second transistor SW2 is controlled to be in off state, the third transistor SW3 is controlled to be in on state, and the fourth transistor SW4 is controlled to be in on state. The driving transistor DRV1 is controlled to be in off state. The writing initialization voltage VREF is controlled to be applied (written) to the first node N1 by the third transistor, and the threshold voltage of the driving transistor DRV1 is stored into the first capacitor C1 after the voltage value at the second node N2 is decreased.

Step S20: dividing a data voltage by using the first capacitor and the second capacitor connected in series between the data voltage and a stable signal, so as to storing an attenuated data voltage on the first capacitor in a writing stage. In this step, the second capacitor is electrically isolated from the light emitting diode. The initialization control signal INITB is at an inactive level, the discharge control signal DSB is in an active level, the dimming control signal EMB is at an inactive level, and the scan signal SCANB is at an active level. So that the first transistor SW1 is controlled to be in on state, the second transistor SW2 is controlled to be in off state, the third transistor SW3 is controlled to be in off state, the fourth transistor SW4 is controlled to be in on state and the driving transistor DRV1 is controlled to be in off state. The attenuated data voltage which is obtained by attenuation of the data voltage DATA is stored in the first capacitor.

Step S30: providing a driving current or a driving voltage to the anode of the light emitting diode based on a power voltage, the threshold voltage, and the attenuated data voltage in a light emitting stage by using a driving transistor in a light emitting stage. In this step, the initialization control signal INITB is at an inactive level, the discharge control signal DSB is at an inactive level, the dimming control signal EMB is in an active level, and the scan signal SCANB is at an inactive level. Further, the first transistor SW1 is controlled to be in off state, the second transistor SW2 is controlled to be in on state, the third transistor SW3 is controlled to be in off state, the fourth transistor SW4 is controlled to be in off state, and the driving transistor DRV1 is controlled to be in on state or off state based on the data voltage DATA. The second transistor SW2 and/or the fourth transistor SW4 are/is in on state or off state, so that the light emitting time can be controlled, and a dimming function is realized.

Further, the method further comprises resetting the voltage of the anode of the light emitting diode at least in the initialization stage and the writing stage. That is, in the present embodiment, the fourth transistor SW4 is in on state during the initialization stage and the writing stage and is configured to discharge the anode of the light emitting diode OLED/LED.

The present disclosure also provides a display device, wherein the pixel circuit in the display panel is the pixel circuit provided in the above embodiment, and the pixel circuit can execute the driving method provided above.

Also, those of ordinary skill in the art will recognize that the various example structures and methods described in connection with the embodiments disclosed herein can be implemented with various configurations or adjustments, with reasonable variations on each structure or structure, but such implementations should not be considered as beyond the scope of the present disclosure. Further, it should be understood that the connection relationship between the various components of the amplifier in the foregoing Figures in this disclosure embodiment is an illustrative example, and does not set any limit to this disclosure embodiment.

It is noted that, herein, relational terms such as first and second, and the like may be used solely to distinguish one entity or action from another entity or action without necessarily requiring or implying any actual such relationship or order between such entities or actions. Also, the terms "comprise", "include" or any other variation thereof, are intended to cover a non-exclusive inclusion, such that a process, method, article, or apparatus that comprises a list of elements does not include only those elements but may include other elements not expressly listed or inherent to such process, method, article, or apparatus. Without further limitation, an element defined by the phrase "comprise an . . . " does not exclude the presence of other identical elements in a process, method, article, or apparatus that comprises the element.

While embodiments in accordance with the disclosure have been described above, these embodiments are not intended to be exhaustive or to limit the disclosure to the precise embodiments described. Obviously, many modifications and variations are possible in light of the above teaching. The embodiments were chosen and described in order to best explain the principles of the disclosure and the practical disclosure, to thereby enable others skilled in the art to best utilize the disclosure and various embodiments with various modifications as are suited to the particular use contemplated. The disclosure is limited only by the claims and their full scope and equivalents.

The invention claimed is:

1. A pixel circuit, comprising:

a light emitting diode;

a first transistor, configured to control an operation of writing a data voltage when the first transistor is in on state, wherein on and off states of the first transistor are controlled by a scan signal;

a second transistor, configured to control a light emitting time of the light emitting diode, wherein on and off states of the second transistor are controlled by a dimming control signal;

a third transistor, configured to control a driving transistor initializing when the third transistor is in on state, wherein on and off states of the third transistor are controlled by an initialization control signal;

a fourth transistor, configured to reset a voltage of an anode of the light emitting diode periodically, wherein on and off states of the fourth transistor are controlled by a discharge control signal;

a first capacitor, configured to store a threshold voltage of the driving transistor in an initialization stage;

a second capacitor, connected in series with the first capacitor between the data voltage and a stable signal, wherein the first capacitor and the second capacitor are for dividing the data voltage in a writing stage, so that the first capacitor is configured to store an attenuated data voltage; and the driving transistor, configured to provide a driving current or a driving voltage to the anode of the light emitting diode based on a power voltage, the threshold voltage, and the attenuated data voltage in a light emitting stage.

2. The pixel circuit according to claim 1, wherein, a gate of the first transistor is connected with a scanning line to receive the scan signal, and a first terminal of the first transistor is connected with a data line to receive the data voltage;

a gate of the second transistor receives the dimming control signal, and a first terminal of the second transistor is connected with a power line to receive the power voltage;

a gate of the driving transistor is connected with a second terminal of the first transistor, a first terminal of the driving transistor is connected with a second terminal of the second transistor, and a second terminal of the driving transistor is connected with the anode of the light emitting diode;

a gate of the third transistor receives the initialization control signal, a first terminal of the third transistor receives an initialization voltage, and a second terminal of the third transistor is connected with the gate of the driving transistor;

a gate of the fourth transistor receives the discharge control signal, a first terminal of the fourth transistor is connected with a discharge voltage, and a second terminal of the fourth transistor is connected with the second terminal of the driving transistor;

the first capacitor is connected between the gate of the driving transistor and the first terminal of the driving transistor;

the second capacitor is connected between the first terminal of the driving transistor and the stable signal; and a cathode of the light emitting diode receives a common voltage.

3. The pixel circuit according to claim 2, wherein the stable signal is any one selected from the power voltage, the initialization voltage, the discharge voltage, the dimming control signal, the initialization control signal, and the discharge control signal.

4. The pixel circuit according to claim 2, wherein the initialization voltage is a constant voltage having a voltage value smaller than a difference between the power voltage and an absolute value of the threshold voltage of the driving transistor, and the initialization control signal is a scan signal for controlling a previous row of pixel circuits.

5. The pixel circuit according to claim 2, wherein the discharge voltage is a constant voltage, and a difference between a voltage value of the constant voltage and a voltage value of the cathode of the light emitting diode is smaller than an on-voltage of the light emitting diode.

6. The pixel circuit according to claim 1, wherein the first capacitor and the second capacitor are selected from one or more of a metal-insulator-metal (MIM) capacitor, a metal-oxide-semiconductor (MOS) capacitor, and a metal-oxide-metal (MOM) capacitor, wherein the first capacitor and the second capacitor are stacked capacitors.

7. A display device comprising a plurality of pixel circuits according to claim 1, and the plurality of pixel circuits are arranged in an array.

8. The display device according to claim 7, wherein the plurality of pixel circuits form a pixel array, first terminals of the first transistors in the pixel circuits in a same column in the pixel array share one data line, and gates of the first transistors in the pixel circuits in a same row in the pixel array share one scanning line;

gates of the second transistors in the pixel circuits in a same row in the pixel array share one dimming control signal, and first terminals of the second transistors in the pixel circuits in a same row in the pixel array share one power voltage, or first terminals of the second transistors in the pixel circuits in the pixel array share one power voltage;

gates of the third transistors in the pixel circuits in a same row in the pixel array share one initialization control signal, and first terminals of the third transistors in the pixel circuits in a same row in the pixel array share one initialization voltage, or first terminals of the third transistors in the pixel circuits in the pixel array share one initialization voltage;

gates of the fourth transistors in the pixel circuits in a same row in the pixel array share one discharge control signal, and first terminals of the fourth transistors in the pixel circuits in a same row in the pixel array share one discharge voltage, or first terminals of the fourth transistors in the pixel circuits in the pixel array share one discharge voltage.

* * * * *